US005139911A

United States Patent [19]

Yagi et al.

[11] Patent Number: 5,139,911

[45] Date of Patent: Aug. 18, 1992

[54] ELECTROPHOTOGRAPHIC PHOTORECEPTOR WITH TWO PART SURFACE LAYER

[75] Inventors: Shigeru Yagi; Masato Ono; Noriyoshi Takahashi; Masayuki Nishikawa; Yuzuru Fukuda; Kenichi Karakida, all of Kanagawa, Japan

[73] Assignee: Fuji Xerox Co., Ltd., Tokyo, Japan

[21] Appl. No.: 456,669

[22] Filed: Dec. 28, 1989

[30] Foreign Application Priority Data

Jan. 4, 1989 [JP] Japan ..... 1-000027

[51] Int. Cl.[5] ..... G03G 5/147

[52] U.S. Cl. ..... 430/66; 430/67

[58] Field of Search ..... 430/66, 67

[56] References Cited

U.S. PATENT DOCUMENTS 4,544,617 10/1985 Mort et al. ..... 430/58

4,837,137 6/1989 Aizawa et al. ..... 430/66

4,882,256 11/1989 Osawa et al. ..... 430/66

*Primary Examiner*—Roland Martin

*Attorney, Agent, or Firm*—Finnegan, Henderson, Farabow, Garrett and Dunner

[57] ABSTRACT

An electrophotographic photoreceptor comprising a conductive support having thereon an amorphous silicon photoconductive layer and a surface protective layer is disclosed, the surface protective layer having a laminated structure comprised of a lower layer comprising nitrogen-containing amorphous silicon and an upper layer comprising amorphous carbon.

The photoreceptor causes no image deletion even after repeated use under a high temperature and high humidity condition and exhibits excellent scratch resistance.

5 Claims, 1 Drawing Sheet

ELECTROPHOTOGRAPHIC PHOTORECEPTOR WITH TWO PART SURFACE LAYER

FIELD OF THE INVENTION

This invention relates to an electrophotographic photoreceptor having a surface layer having improved hardness, which does not cause image deletion (image blurring) even after repeated use.

BACKGROUND OF THE INVENTION

Recently developed electrophotographic photoreceptors include those comprising a conductive support having thereon a photoconductive layer mainly comprising amorphous silicon. The photoreceptors of this type are excellent in mechanical strength, panchromatic properties, and sensitivity to long wavelength light as compared with those having a photoconductive layer comprising other inorganic photoconductive materials, e.g., Se, tri-Se, ZnO or CdS, or various organic photoconductive materials. However, they cause image deletion when left to stand in the atmosphere, particularly under a high temperature and high humidity condition. Besides, the surface of the photoconductive layer tends to receive scratches due to contact with a toner cleaning blade or a paper stripping click during electrophotographic processing, to cause white streaks on an image of copies.

In order to improve scratch resistance of a photosensitive layer, it has been proposed to provide a surface layer having a composition, such as $SiN_x$, $SiO_x$, and $SiC_x$, which does not impair hardness of a photosensitive layer mainly comprising silicon. The above disadvantage can be removed by providing such a surface layer. It has also been proposed to provide a surface layer comprising amorphous carbon for the purpose of improving endurance against repeated use under a high temperature and high humidity condition as disclosed in JP-A-61-250655 (the term "JP-A" as used herein means an "unexamined published Japanese patent application").

However, electrophotographic photoreceptors having a surface layer comprising $SiN_x$, $SiO_x$, $SiC_x$, etc. turned out to cause image deletion on repeated use in a high temperature and high humidity condition, proving practically useless. Further, those having a surface layer comprising amorphous carbon turned out to induce reduction of surface potential.

SUMMARY OF THE INVENTION

Accordingly, an object of this invention is to provide an electrophotographic photoreceptor causing no image deletion under any operating conditions, and particularly even when repeatedly used for a long term under a high temperature and high humidity condition.

Another object of this invention is to provide an electrophotographic photoreceptor having sufficient surface hardness while exhibiting high electrical charge receptivity.

The present invention provides an electrophotographic photoreceptor comprising a conductive support having thereon a photoconductive layer comprising amorphous silicon and a surface protective layer, wherein said surface protective layer has a laminated structure composed of a lower layer comprising nitrogen-containing amorphous silicon and an upper layer comprising amorphous carbon. In the photoreceptor of this invention, the lower and upper layers constituting the surface protective layer exhibit excellent adhesion to each other to thereby provide a highly durable electrophotographic photoreceptor.

DETAILED DESCRIPTION OF THE INVENTION

Figure 1:
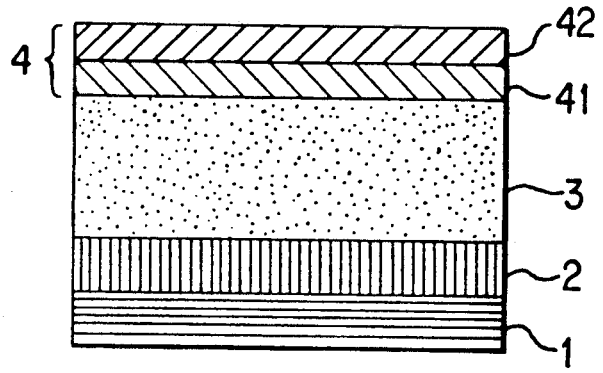
FIG. 1 schematically illustrates a cross section of the electrophotographic photoreceptor according to the present invention, wherein 1 denotes a conductive support, 2 denotes a charge barrier layer, 3 denotes a photosensitive layer, 4 denotes a surface protective layer having a laminated structure, 41 denotes a lower layer and 42 denotes a upper layer.

Conductive support 1 is made of a material appropriately selected according to the end use from among metals, e.g., aluminum, nickel, chromium, and stainless steel; synthetic resin sheets having a conductive film; glass; paper; and the like.

Photosensitive layer 3 mainly comprises amorphous silicon and is formed on the conductive support by glow discharge, sputtering, ionic plating, or the like film forming techniques. While the film forming technique to be employed is chosen appropriately depending on the end use, a plasma CVD method in which a raw material gas is decomposed by a glow discharge is preferred.

Raw materials of the photosensitive layer include silanes, e.g., monosilane and disilane, and silicon crystals. If desired, various mixed gases, such as a mixed gas containing a carrier gas, e.g., hydrogen, helium, argon, and neon, may be used in the formation of the photosensitive layer. For the purpose of controlling dark resistance or electrification polarity of the photosensitive layer, a dopant gas, e.g., diborane ($B_2H_6$) or phosphine ($PH_3$), may be added to the raw material gas to dope the photoconductive layer with impurities, e.g., boron or phosphorus. Further, the photosensitive layer may contain a halogen atom, a carbon atom, an oxygen atom, or a nitrogen atom for the purpose of increasing dark resistance, photosensitivity or charging capacity (charging capacity or charge potential per unit film thickness). The photosensitive layer may furthermore contain germanium, etc. for the purpose of increasing sensitivity in the long wavelength region. In particular, the photosensitive layer is preferably an i-type semi-conductor layer comprising silicon as a main component and a trace amount of the group IIIa element (preferably boron).

Incorporation of these various elements into a photosensitive layer can be achieved by introducing silane gas as a main raw material together with a gaseous substance containing the desired element into a plasma CVD apparatus to conduct glow discharge decomposition.

Conditions of glow discharge decomposition using, for instance, an alternating current are generally from 0.1 to 30 MHz, and preferably from 5 to 20 MHz, in frequency; from 0.1 to 5 To. (13.3 to 667 Pa) in degree of vacuum on discharging; and from 100 to 400° C., in heating temperature of a support.

Thickness of the photosensitive layer is arbitrary and usually selected from 1 to 200 μm, and preferably from 5 to 100 μm.

The electrophotographic photoreceptor according to the present invention can have, if desired, additional layers between the photosensitive layer and the conductive support for controlling electrical and image forming characteristics of the photoreceptor. Such additional layers include a charge barrier layer, such as a p-type or n-type semi-conductor layer comprising amorphous silicon doped with the group III or V element (layer 2 in FIG. 1); an insulating layer; a sensitizing layer, such as a layer comprising amorphous silicon doped with microcrystalline germanium or tin; an adhesion layer for improving adhesion to a support, such as a layer comprising amorphous silicon doped with nitrogen, carbon or oxygen; and a layer containing both the group III element and the group V element.

Each of these optional layers has an arbitrary film thickness, usually selected from 0.01 to 10 μm.

According to the present invention, the photosensitive layer has thereon a surface protective layer composed of lower layer (41) comprising nitrogen-containing amorphous silicon and upper layer (42) comprising amorphous carbon.

Lower surface protective layer (41) is formed, for example, by introducing silane and a raw material gas containing nitrogen into a plasma CVD apparatus and conducting glow discharge decomposition. The nitrogen-containing raw material gas may be any of single substances or compounds which contains nitrogen as a constituting element and can be used in a gaseous phase, such as $N_2$ gas and gaseous nitrogen hydrides, e.g., $NH_3$, $N_2H_4$, and $HN_3$.

A nitrogen atom concentration in the lower layer preferably ranges from 0.1 to 1.0 in terms of atom number ratio to silicon atom. During lower layer formation, the nitrogen concentration in the raw material gas may be varied so as to provide a lower layer of a laminated structure having two different nitrogen concentrations. The lower layer preferably has a thickness of from 0.01 to 5 μm, more preferably from 0.1 to 2 μm.

Conditions of glow discharge decomposition for lower layer formation using, for instance, an alternating current are usually from 0.1 to 30 MHz, and preferably from 5 to 20 MHz, in frequency; from 0.1 to 5 Torr (13.3 to 667 Pa) in degree of vacuum during discharge; and from 100 to 400° C. in heating temperature of a support.

Upper surface protective layer (42) is characterized by comprising amorphous carbon mainly constituted by carbon and hydrogen. The amount of hydrogen in the upper layer should not exceed 50 atom%. Too a large amount of hydrogen increases linear —$CH_2$— bonds or —$CH_3$ bonds in the film, resulting in impairment of film hardness. The upper layer is formed in an atmosphere containing hydrogen by glow discharge, sputtering, ionic plating or the like techniques. Inter alia, a plasma CVD method is preferred.

Raw materials which can be used for upper layer formation include aliphatic hydrocarbons (preferably from 1 to 7 carbon atoms), such as paraffinic hydrocarbons represented by formula $C_nH_{2n+2}$, e.g., methane, ethane, propane, butane, and pentane, olefin hydrocarbons represented by formula $C_nH_{2n}$, e.g., ethylene, propylene, butylene, and pentene, and acetylenic hydrocarbons represented by formula $C_nH_{2n-2}$, e.g., acetylene, allylene, and butyne; alicyclic hydrocarbons (preferably from 3 to 7 carbon atoms), e.g., cyclopropane, cyclobutane, cyclopentane, cyclohexane, cycloheptane, cyclobutene, cyclopentene, and cyclohexene; and aromatic compounds, e.g., benzene, toluene, xylene, naphthalene, and anthracene; and their organic substituted compounds. These raw materials may have a branched structure and may be substituted with a halogen atom. Examples of halogen-substituted compounds are halogenated hydrocarbons such as carbon tetrachloride, chloroform, carbon tetrafluoride, trifluoromethane, chlorotrifluoromethane, dichlorodifluoromethane, bromotrifluoromethane, perfluoroethane, and perfluoropropane.

The above-enumerated carbon raw materials may be gaseous, solid, or liquid at room temperature. Solid or liquid materials are used after vaporization.

In carrying out upper layer formation, at least one gaseous material selected from among the above-described raw materials is introduced into a vacuum container, and a glow discharge is established to form an upper layer comprising amorphous carbon mainly composed of carbon and hydrogen on a photosensitive layer. If desired, the gaseous material may be used in combination with a third gaseous substance different from the gaseous raw material. The third gaseous substance to be used includes carrier gases, e.g., hydrogen, helium, argon, and neon.

Glow discharge decomposition of the raw material by plasma CVD method is feasible with either of a direct current or an alternating current. Conditions for film formation are usually from 0.1 to 30 MHz, and preferably from 5 to 20 MHz, in frequency; from 0.1 to 5 Torr (13.3 to 667 Pa) in degree of vacuum during discharging; and from 100 to 400° C. in heating temperature of a support. The upper layer thickness is arbitrarily selected and usually ranges from 0.01 to 10 μm, and preferably from 0.2 to 5 μm.

The electrophotographic photoreceptor according to the present invention provides an initial image of stable and high quality under any environmental condition on use and causes no image deterioration upon repeated use.

The present invention is now illustrated in greater detail with reference to Examples, but it should be understood that the present invention is not deemed to be limited thereto.

EXAMPLE 1

A cylindrical aluminum support was mounted at a prescribed position of a capacitance-coupled plasma CVD apparatus, and a mixed gas consisting of silane gas ($SiH_4$), diborane gas ($B_2H_6$), and hydrogen gas was introduced into the reaction chamber to conduct glow discharge decomposition under the following conditions to thereby form a 2μm thick amorphous silicon-based p-type photoconductive layer as a charge barrier layer.

Film Forming Conditions:

Silane Gas Flow Rate: 100 $cm^3$/min
100 ppm Hz-diluted Diborane Gas Flow Rate: 100 $cm^3$/min
Inner Pressure of Reactor: 1.0 Torr
Discharge Voltage: 200 W
Discharge Frequency: 13.56 MHz
Support Temperature: 250° C.

Subsequently, film formation was carried out in the same manner as described above, except for replacing the 100 ppm $H_2$-diluted diborane gas with 2 ppm $H_2$-diluted diborane gas to form a 20 μm thick amorphous silicon-based i-type photoconductive layer. The thus formed layer had an optical gap of 1.7 eV.

On the photoconductive layer was formed a 0.2 μm thick lower surface protective layer comprising nitrogen-containing amorphous silicon by glow discharge decomposition of a mixed gas consisting of silane gas, ammonia gas, and hydrogen gas under the following conditions.

Film Forming Conditions

100% Silane Gas Flow Rate: 50 $cm^3$/min
Ammonia Gas Flow Rate: 50 $cm^3$/min
Hydrogen Gas Flow Rate: 100 $cm^3$/min
Inner Pressure of Reactor: 0.5 Torr
Discharge Voltage: 100 W
Discharge Frequency: 13.56 MHz
Support Temperature: 250° C.

Finally, a 0.5 μm thick upper surface protective layer comprising amorphous carbon was formed on the lower surface protective layer by glow discharge decomposition of a mixed gas consisting of ethylene gas and hydrogen gas under the following conditions:

Film Forming Conditions

Ethylene Gas Flow Rate: 100 $cm^3$/min
Hydrogen Gas Flow Rate: 50 $cm^3$/min
Inner Pressure of Reactor: 0.5 Torr
Discharge Voltage: 500 W
Discharge Frequency: 13.56 MHz
Support Temperature: 250° C.

There was thus obtained an electrophotographic photoreceptor comprising an aluminum support having provided thereon, a charge barrier layer, a photoconductive layer, a first (lower) surface protective layer, and a second (upper) surface protective layer in this order. The electrophotographic photoreceptor was set in a copying machine, and copying was carried out under an environmental condition of 10° C. and 15% RH, 20° C. and 50% RH, or 30° C. and 85% RH.

As a result, copies obtained both in the initial stage ad after obtaining 20,000 copies suffered no image deletion and exhibited high image density without fog irrespective of the environmental condition. Further, there was observed no image defects due to scratches of the photoreceptor and the like.

COMPARATIVE EXAMPLE 1

On an cylindrical aluminum support were formed a 2 μm thick amorphous silicon p-type photoconductive layer, a 20 μm thick amorphous silicon i-type photoconductive layer, and a 0.5 μm thick nitrogen-containing amorphous silicon surface protective layer in the same manner as in Example 1.

Copying test of the resulting electrophotographic photoreceptor was carried out in the same manner as in Example 1. As a result, image deletion was observed after obtaining 1,000 copies under the environmental condition of 30° C. and 85% RH.

COMPARATIVE EXAMPLE 2

On a cylindrical aluminum support were formed a 2 μm thick amorphous silicon p-type photoconductive layer, a 20 μm thick amorphous silicon i-type photoconductive layer, and a 0.5 μm thick amorphous carbon surface protective layer in the same manner as in Example 1.

Copying test of the resulting electrophotographic photoreceptor was carried out in the same manner as in Example 1. As a result, copies obtained had only a low image density from the very beginning of copying.

EXAMPLE 2

On a cylindrical aluminum support were formed a 2 μm thick amorphous silicon p-type photoconductive layer and a 20 μm thick amorphous silicon i-type photoconductive layer in the same manner as in Example 1.

Then, a lower surface protective layer composed of two layers having a thickness of 0.1 μm and 0.3 μm, respectively, each comprising nitrogen-containing amorphous silicon of different composition was formed using a mixed gas consisting of silane gas, ammonia gas, and hydrogen gas by altering film forming conditions as follows.

First Film Forming Conditions

100% Silane Gas Flow Rate: 50 $cm^3$/min
Ammonia Gas Flow Rate: 50 $cm^3$/min
Hydrogen Gas Flow Rate: 100 $cm^3$/min
Inner Pressure of Reactor: 0.5 Torr
Discharge Voltage: 200 W
Discharge Frequency: 13.56 MHz
Support Temperature: 250° C.

Second Film Forming Conditions

100% Silane Gas Flow Rate: 40 $cm^3$/min
Ammonia Gas Flow Rate: 60 $cm^3$/min
Hydrogen Gas Flow Rate: 100 $cm^3$/min
Inner Pressure of Reactor: The same as above.
Discharge Voltage: do.
Discharge Frequency: do.
Support Temperature: do.

Subsequently, a mixed gas consisting of ethylene gas and hydrogen gas was introduced into the reaction chamber to conduct glow discharge decomposition to form a 0.5 μm thick upper surface protective layer comprising amorphous carbon under the following conditions.

Film Forming Conditions

Ethylene Gas Flow Rate: 100 $cm^3$/min
Hydrogen Gas Flow Rate: 50 $cm^3$/min
Inner Pressure of Reactor: 0.5 Torr
Discharge Voltage: 500
Discharge Frequency: 13.56 MHz
Support Temperature: 200° C.

There was obtained an electrophotographic photoreceptor comprising an aluminum support having provided thereon a charge barrier layer, a photoconductive layer, a double-layered first (lower) surface protective layer, and a second (upper) surface protective layer.

Copying test of the resulting photoreceptor was carried out in the same manner as in Example 1. As a result, copies obtained both in the initial stage and after obtaining 20,000 copies suffered from no image deletion and exhibited fog-free high image density under any environmental condition. Further, there was observed no image defects due to scratches on the photoreceptor and the like.

As described above, the electrophotographic photoreceptor according to the present invention is characterized in that the surface protective layer thereof has a laminated structure composed of a lower layer comprising nitrogen-containing amorphous silicon and an upper layer comprising amorphous carbon mainly comprising hydrogen and carbon. The surface protective layer having such a specific structure has very high surface hardness. Further, the nitrogen-containing amorphous silicon constituting the lower surface protective layer exhibits excellent adhesion to the upper surface protective layer. Hence, the electrophotographic photoreceptor of the present invention hardly receives scratches on contact with a cleaning blade, a paper stripping click, etc. and causes no image deletion under any operating conditions. In particular, the photoreceptor of the invention does not cause any image deletion or reduction of image density even after long-term repeated use under a high temperature and high humidity condition, thus having a high practical value.

While the invention has been described in detail and wit reference to specific embodiments thereof, it will be apparent to one skilled in the art that various changes and modifications can be made therein without departing from the spirit and scope thereof.

What is claimed is:

1. An electrophotographic photoreceptor comprising a conductive support having thereon an amorphous silicon photoconductive layer and a surface protective layer wherein said surface protective layer has a laminated structure comprising an upper layer and a lower layer, wherein said lower layer comprises a composite structure including at least two nitrogen-containing amorphous silicon layers having differing nitrogen concentrations, and wherein said upper layer comprises amorphous carbon.

2. An electrophotographic photoreceptor as claimed in claim 1, wherein said lower surface protective layer contains nitrogen in a proportion of from 0.1 to 1.0 in terms of atom number ratio to silicon atom.

3. An electrophotographic photoreceptor as claimed in claim 1, wherein said lower surface protective layer has a thickness of from 0.01 to 5 μm and said upper surface protective layer has a thickness of from 0.01 to 10 μm.

4. An electrophotographic receptor as claimed in claim 1, wherein said laminated structure comprises a lower layer and no more than one upper layer.

5. An electrophotographic photoreceptor as claimed in claim 1, wherein said lower layer has an upper portion and a lower portion, said upper portion having a nitrogen concentration which is higher than the nitrogen concentration of said lower portion.

* * * * *